United States Patent [19]

Gurkov et al.

[11] Patent Number: 4,637,476

[45] Date of Patent: Jan. 20, 1987

[54] PERCUSSIVE ACTION MACHINE FOR MAKING HOLES IN THE GROUND

[75] Inventors: Konstantin S. Gurkov; Alexandr D. Kostylev; Gennady A. Tkachenko; Ivan P. Leonov; Vladimir V. Klimashko, all of Novosibirsk, U.S.S.R.

[73] Assignee: Institut Gornogo Dela Sibirskogo Otdelenia Akademii Nauk SSSR, Novosibirsk, U.S.S.R.

[21] Appl. No.: 720,285

[22] Filed: Apr. 4, 1985

[51] Int. Cl.[4] ..... E21B 1/00

[52] U.S. Cl. ..... 173/136; 173/137; 175/19

[58] Field of Search ..... 173/134–138, 173/91; 175/19; 91/229

[56] References Cited

U.S. PATENT DOCUMENTS 2,403,582 7/1946 Caudill ..... 173/137 X
3,095,047 6/1963 Fleischer et al. ..... 173/137
3,705,633 12/1972 Sudinishnikov et al. ..... 173/91

FOREIGN PATENT DOCUMENTS 227198 9/1968 U.S.S.R. .
531907 10/1976 U.S.S.R. .

OTHER PUBLICATIONS

"Mining Machines", Collection of Reports, Novosibirsk, 1980, Increasing the Impact Power of Percussive Action Machines, pp. 14–20.

*Primary Examiner*—James M. Meister
*Assistant Examiner*—John L. Knoble
*Attorney, Agent, or Firm*—Fleit, Jacobson, Cohn & Price

[57] ABSTRACT

A percussive action machine includes a housing in which a hammer is movably secured to define a forward stroke chamber and a return stroke chamber. The hammer is provided with an air-distributor fashioned as a sleeve having holes. The hammer is further provided with a device for alternately communicating the return stroke chamber with the forward stroke chamber and with the outside, the device having the form of at least one bore arranged inside the hammer in line with its axis. Communicating with this bore is a tubular control valve extending through the forward stroke chamber and having in its wall at least one hole wherethrough the return stroke chamber alternately communicates with the forward stroke chamber and with the outside.

5 Claims, 9 Drawing Figures

PERCUSSIVE ACTION MACHINE FOR MAKING HOLES IN THE GROUND

FIELD OF THE INVENTION

This invention relates to air-operated percussive action machines used in civil engineering and mining, and more particularly to machines for making holes in the ground.

BACKGROUND ART

The invention can find a most beneficial application in devices intended for making horizontal, inclined and vertical holes in the ground being compacted during trenchless laying of underground communication lines under highways, earth embankments and other structures.

The machine according to the invention can also be used for driving piles, down-the-hole soil compacting, as well as for forcing tubes and other structural elements in the ground.

A widespread use has found self-propelled pneumatic percussive action machines for driving holes in the ground by soil compacting. The principal working member of such a machine is a cylindrical housing with the interior thereof accommodating a hammer and an air-distributor. Used as a working medium is compressed air supplied along a flexible hose from a mobile compressor unit. During operation the compressed air fed to the working chambers through the air distributor makes the hammer reciprocate axially to deliver an impact on the housing. Under the action of the impacts the housing is forced into the ground in a pile-like manner, whereby a substantially straight well or hole is formed with smooth, soil-compacted walls. The diameter of such a hole equals the diameter of the percussive action machine.

Because retrieval of percussive action machines from the soil due to failure is very often difficult if not impossible (when making holes under railways or airport runways), they must be sufficiently reliable and have a long service life. Another important characteristic is their efficiency determined mostly by the impact power they produce.

There is known a machine for making holes in the ground (cf., USSR Inventor's Certificate No. 227,198. IPC E 02 F 5/18) which comprises a housing accommodating a reciprocable hammer defining inside the housing a forward stroke chamber continuously communicating with an air-feeding line, and a return stroke chamber alternately communicating with the forward stroke chamber and with the outside through a conduit means provided in the hammer in the form of a bore made in the hammer to extend perpendicularly to the longitudinal axis thereof, and an air-distributor in the form of a sleeve having holes.

The forward stroke chamber is defined here by the hammer and air-distributor and disposed in an axial bore made inside the hammer, which makes it necessary to use a hammer with rather thin walls.

Inherent in the aforedescribed percussive action machine is a disadvantage of relatively short service life, because of insufficient hammer wall thickness and stress concentrations in the hammer where its configuration suddenly changes at the point of termination of the axial bore, as well as because of the provision of the radial holes in the walls of the hammer (wherethrough the return stroke chamber defined by the outer surface of the hammer and the inner surface of the housing communicates with the forward stroke chamber).

For a greater length of the forward stroke of the hammer the return stroke chamber is not communicated with the outside, whereby a counterpressure is developed therein to exert a decelerating action on the hammer and reduce its impact power.

In turn, impact power of the machine cannot be increased by extending the length of the working stroke of the hammer. Therefore, a major structural parameter governing the impact power developed by the machine is the diameter of the hammer and, consequently, the diameter of the machine. However, such an increase in the diameter results in an increased bulk of the machine and resistance to its travel through the soil to affect the speed of hole making.

There is also known a machine for making holes in the ground (cf., "Gornye machiny"—Mining Machines, in Russian, Collection of Reports, AN SSSR, Sibirskoe otdelenie, Institut gornogo dela, Novosibirsk, 1980, pp. 14 to 20) comprising a cylindrical housing accommodating a reciprocable hammer which defines inside the housing a forward stroke chamber continuously communicating with an air-feeding line, and a return stroke chamber communicating alternately with the forward stroke chamber and with the outside through a conduit means provided in the hammer and having the form of a hole perpendicular to the longitudinal axis of the hammer, the hammer also having an air-distributor fashioned as a sleeve with holes and a tubular control valve secured in the housing and movable relative to the sleeve.

The provision of the movable tubular control valve makes it possible to increase the length of work stroke of the hammer (to consequently obtain a higher impact power and improved machine efficiency at the same outer diameter) because the hammer is returned through not only the expansion of compressed air in the return stroke chamber, but also due to the compressed air tending to occupy this chamber for a part of the return stroke of the hammer equal to the length of travel of the tubular control valve.

However, because of similar stress concentrations as is the case with the machine described in USSR Inventor's Certificate No. 227,198, and thin walls of the hammer, this prior art machine has a relatively short service life.

For a portion of the forward stroke of the hammer equal to the length of the tubular control valve a counter pressure is developed in the return stroke chamber exerting a braking effect on the hammer and reducing the impact power.

One condition for stable operation of the machine is simultaneous movement of the tubular control valve and hammer during the travel of the control valve from one extreme position to the other.

On the other hand, since such simultaneous movement is ensured by the forces of friction in action between the hammer and tubular control valve varying widely under impact and vibration loads, this condition can be met in practice with difficulty.

There is further known a percussive action machine for making holes in the ground (cf., USSR Inventor's Certificate No. 531,907; IPC E 02 F 5/18) comprising a cylindrical housing accommodating a reciprocable hammer defining inside the housing a forward stroke chamber continuously communicating with an air-feeding line, and a return stroke chamber communicating alternately with the forward stroke chamber and with the outside through a conduit means in the hammer provided with an air-distributor in the form of a sleeve with holes secured in the housing, and a tubular control valve movably arranged relative to the sleeve for opening and closing the holes in the sleeve, as well as a locking means for moving the control valve and setting it in two extreme positions, in one of which the return stroke chamber communicates through the conduit means in the hammer and through the air-distributor with the outside, whereas in the other position the return stroke chamber communicates with the forward stroke chamber.

The sleeve of the air-distributor comprises inlet and discharge passages defined by two coaxially-arranged tubes, the sleeve being disposed inside an axial bore of the hammer. During the forward stroke of the hammer compressed air is admitted both to the return stroke chamber and to the chamber formed by the end faces of the hammer and air-distribution sleeve, whereby the pressure of compressed air acts on the entire cross-sectional area of the hammer.

Compressed air is admitted to the chamber formed by the end faces of the hammer and sleeve and discharged thereform by opening and closing ports of the sleeve by the tubular control valve.

The forward stroke chamber is provided in the axial bore of the hammer, whereas the conduit means has the form of holes in the wall of the hammer, these holes causing substantial stress concentrations. In addition, the eleborate configuration of the hammer and the large diameter of the axial bore (due to the accommodation of the sleeve having inlet and discharge passages) affect the service life of the hammer.

Because through the greater length of the forward stroke of the hammer the return stroke chamber is not in communication with the outside, a counterpressure tends to develop therein to exert a decelerating effect on the hammer. In addition, the return travel of the hammer is effected exclusively thanks to the expansion of compressed air in the return stroke chamber. In other words, the prior art machine fails to make use of the energy resulting from the occupation of the return stroke chamber by compressed air. All this reduces the impact power of the machine and its efficiency.

It is an object of the present invention to improve the efficiency and reliability of a percussive action machine for making holes in the ground.

Another object is to simplify the machine structurally and increase the impact power developed by its hammer.

SUMMARY OF THE INVENTION

The objects of the present invention are attained in a percussive action machine for making holes in the ground comprising a cylindrical housing accommodating a reciprocable hammer defining inside the housing a forward stroke chamber continuously communicating with an air-feeding line and a return stroke chamber communicating alternately with the forward stroke chamber and with the outside through a conduit means provided in the hammer, which includes an air-distributor fashioned as a sleeve having holes and secured in the housing, and a tubular control valve movably arranged relative to the sleeve to be capable of opening and closing the holes in the sleeve, and a locking means for moving the tubular control valve and fixing it in two extreme positions in one of which the return stroke chamber communicates with the outside through the conduit means provided in the hammer and through the air-distributor, in the other extreme position the return stroke chamber communicating with the forward stroke chamber, according to the invention, the forward stroke chamber is defined between end faces of the sleeve and hammer, whereas the conduit means has the form of at least one bore provided in the hammer in line with its axis, this bore communicating with the tubular control valve extending through the forward stroke chamber and having in its wall at least one hole wherethrough the return stroke chamber communicates alternately with the forward stroke chamber and with the outside.

Such a construction of the percussive action machine makes it possible to extend its service life by virtue of the absence in parts subjected to impact loads of elements susceptible to stress concentrations, such as transverse holes and sudden variations in the configuration of the hammer. This also enables a substantial increase in the impact power developed by the hammer (and consequently makes the machine more efficient) through elongating the stroke of the hammer, since during the travel of the hammer toward the reduction in the volume of the return stroke chamber the latter continously communicates with the outside through the conduit means in the hammer and air-distributor, whereby no counter-pressure exerting a braking effect on the hammer is produced.

Preferably, the sleeve has a projecting tubular portion the wall of which is provided with holes, whereas a free end thereof is received by the bore of the hammer and it has slidably arranged thereon the tubular control valve of the air-distributor so that in its extreme position it acts to alternately close the holes of the tubular portion of the sleeve wherethrough the return stroke chamber communicates alternately with the forward stroke chamber and with the outside.

This arrangement enables the prevention of the action of the forces of friction on the tubular control valve caused by the hammer, these forces of friction otherwise tending to displace the tubular control valve from a position which it assumes thanks to the action of the locking means of the hammer. Therefore, the machine operates more reliably (thanks to a more stable working cycle), which is especially important for percussive action machines with elongated hammer strokes.

Advisably, the tubular control valve is provided with a spring means ensuring its compression to the sleeve subsequent to the acceleration of the hammer during its return stroke.

This arrangement renders the machine more fail-safe through a reliable fixation of the tubular control valve in its extreme position (when the return stroke chamber communicates with the outside through the conduit means and air-distributor) by the spring means, thus preventing accidental displacements of the control valve relative to the sleeve under the action of impact and vibration loads exerted on the housing of the machine, and makes the machine shorter in length through minimizing the travel of the tubular control valve relative to the sleeve. Such an arrangement is especially advantageous for machines in which the deceleration travel of the hammer is comparable with the travel length of its acceleration during the return stroke.

Alternatively, the tubular control valve has the form of two relatively movable and coaxially cooperating tubes, the wall of at least one of these tubes having holes closable by the other tube, through which holes the return stroke chamber alternately communicates with the forward stroke chamber and with the outside.

Such an arrangement of the tubular control valve provides a more economical cycle in which a more efficient use can be made of the power of the compressed air source (compressor unit) thanks to utilizing the energy of compressed air for producing useful work; this arrangement being especially preferable in machines of a relatively large (over 200 mm) outer diameter.

Advisably, the tubular control valve has the form of two parallel tubes, the walls of each of these tubes having at least one hole so that in its extreme positions the sleeve closes the hole of one of the tubes wherethrough the return stroke chamber communicates with the forward stroke chamber and the hole of the other tube wherethrough the return stroke chamber communicates with the outside.

Owing to the fact that each of the parallel tubes has only one mounting surface (viz., outer surface), less stringent tolerances are required during the manufacture of mating paths.

BRIEF DESCRIPTION OF THE DRAWINGS

The invention will now be described in greater detail with reference to various preferred embodiments thereof taken in conjunction with the accompanying drawings, in which.

DETAILED DESCRIPTION OF THE PREFERRED EMBODIMENTS

Figure 1:
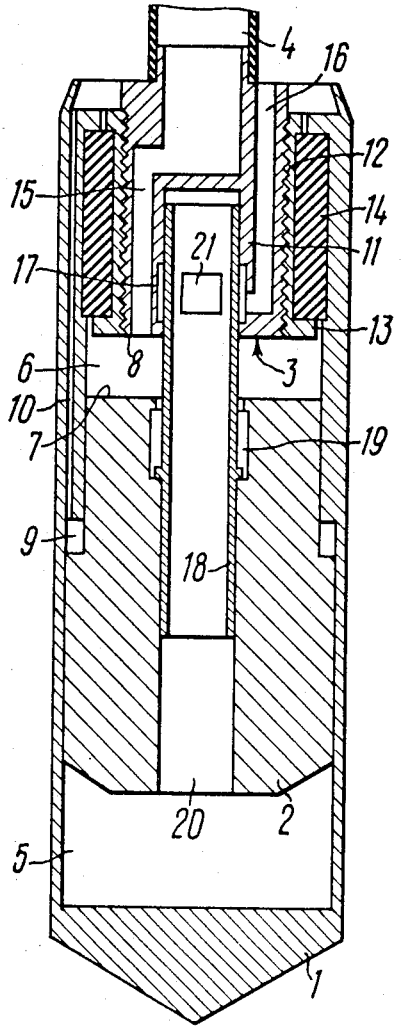
FIG. 1 is a longitudinal sectional view of a percussive action machine for making holes in the ground showing a hammer during its return stroke.

A percussive action machine for making holes in the ground (FIG. 1) comprises a cylindrical housing 1, a hammer 2, and an air-distributor 3 communicating with an air-feeding line 4. The hammer 2 and the air-distributor 3 divide the interior of the housing 1 into three chambers, particularly a return stroke chamber 5, a forward stroke chamber 6 occupying a space between an end face 7 of the hammer 2 and an end face 8 of the air-distributor 3, and a discharge chamber 9 continuously communicating with the outside through a passage 10.

The air-distributor 3 includes a sleeve 11 engaged by a thread 12 in a nut 13 (FIG. 1) secured in the housing 1 through a resilient element 14 (to compensate for manufacturing inaccuracies of the mating elements). Air distributor 3 includes an inlet hole 15 communicable with the air-feeding line 4 and a discharge hole 16 one end of which terminates in a recess made in the sleeve 11, whereas the other end communicates with the outside, and a tubular control valve 18 extending through the forward stroke chamber 6 and serving to open and close the hole 16 during its travel relative to the sleeve 11.

The aforedescribed embodiment of the percussive action machine according to the invention, in which thanks to the arrangement of the return stroke chamber 5 outside of the hammer 2 the latter has a substantially uniform configuration, whereas air conduit means are fashioned as passages extending in parallel with the longitudinal centerline of the hammer (impact pulse action line), makes it possible to increase the service life of the machine by virtue of obviating stress concentrations in the parts thereof acted upon by impact loads.

Figure 4:
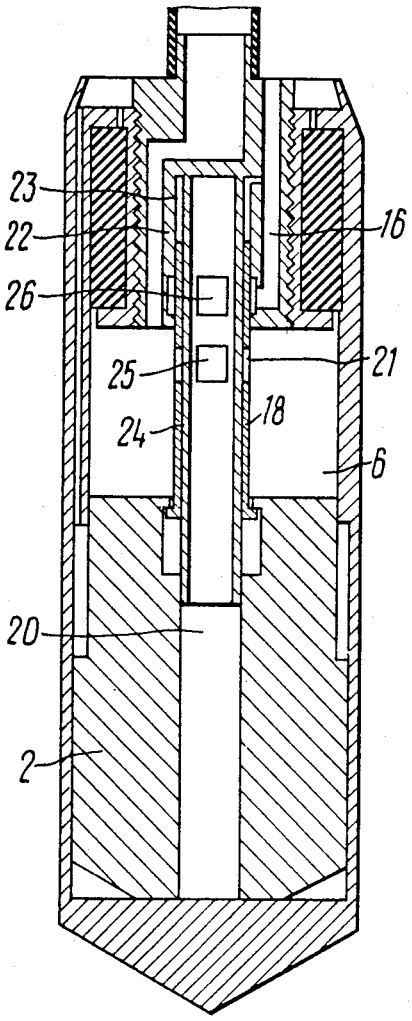
FIG. 4 is a longitudinal schematic sectional view of an alternative embodiment of the proposed percussive action machine in which the sleeve of an air-distributor has a projecting tubular portion, a free end of which is received by a bore of the hammer and it has mounted thereon a tubular control valve of the air-distributor.

With reference to FIG. 4, another modification of the percussive action machine according to the invention includes a sleeve 22 serving the same purpose as the sleeve 11 in the embodiment represented in FIG. 1. This sleeve 22 has an annular slot 23 in which the control valve 18 is received and a projecting tubular portion 24 the free end of which is disposed inside a bore 20 of the hammer 2; its wall having a hole 25 which, upon registration with a hole 21 of the tubular control valve 18, communicates with the forward stroke chamber 6, as well as a hole 26 which communicates through the discharge passage 16 with the outside upon registration with the hole 21 of the tubular control valve 18. Therewith, the tubular control valve 18 is not subjected to friction forces from the hammer 2, and therefore it is necessary that the forces of friction acting on the tubular control valve 18 from the tubular portion 24 of the sleeve 22 could overcome or be greater than the weight force of the valve 18 (this being a prerequisite for reliable operation of the proposed machine when drilling substantially vertical holes).

Figure 5:
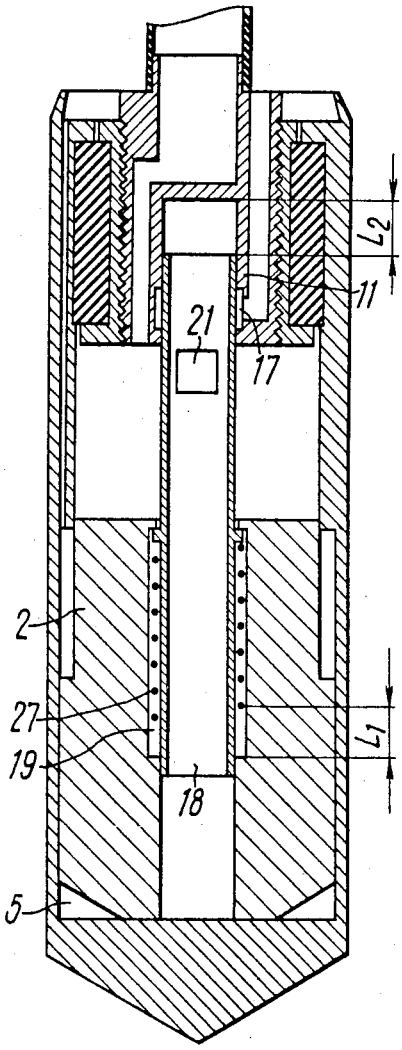
FIG. 5 is a longitudinal sectional view of an alternative embodiment of the percussive action machine according to the invention in which the tubular control valve is provided with a spring means, the hammer being shown while terminating its forward stroke.

In an alternative modification of the percussive action machine according to the invention represented in FIG. 5 the tubular control valve 18 is provided with a spring means 27 to force the valve 18 toward the sleeve 11 subsequent to acceleration of the hammer 2 (viz., travel at a distance $L_1$) during the return stroke and during part of the travel of the hammer 2 in the forward stroke. The length of travel of the tubular control valve 18 between its extreme positions with such an arrangement of the machine is minimal to depend only on the size of its hole 21 (as seen best in FIG. 5, the length $L_2$ of travel of the tubular control valve 18 approximates the length of the hole 21 of the tubular control valve 18 as measured along the longitudinal centerline of the machine).

By virtue of the fact that fixing the tubular control valve 18 in one of its extreme positions is ensured by the spring means 27 rather than the force of friction, it is possible to considerably reduce the forces of friction between the tubular control valve 18 and sleeve 11 and thereby reduce friction heat release to result in a longer life and trouble-free operation of the machine.

Figure 6:
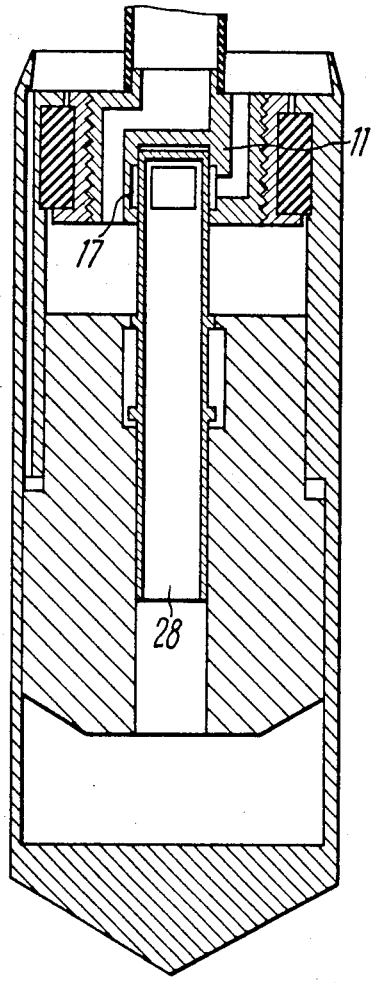
FIG. 6 is a schematic illustration of yet another embodiment of the proposed percussive action machine in which the tubular control valve of the air-distibutor has a blind end.

According to the embodiment of the percussive action machine illustrated in FIG. 6, the tubular control valve has the form of a blind-end tube 28, the control valve and the sleeve 11 being of substantially shorter axial length, since at the extreme position of the tubular control valve 18 corresponding to the termination of the forward stroke of the hammer it is not required that the wall of the tubular control valve 18 should close the recess 17 in the sleeve 11, as is indispensible in the modification of the percussive action machine with reference to FIG. 1.

Figure 7:
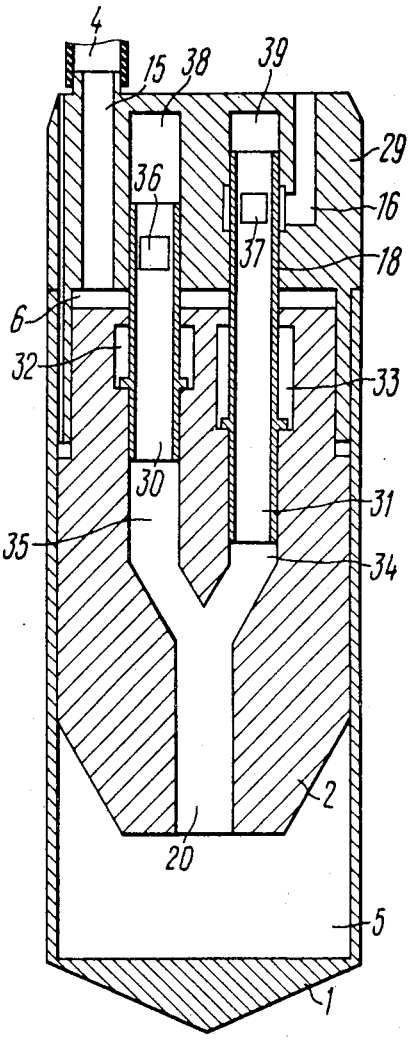
FIG. 7 is a longitudinal sectional view of one more alternative embodiment of the percussive action machine in which the tubular control valve has the form of two parallel tubes, the hammer being shown while terminating its return stroke.

Referring now to FIG. 7, there is shown an alternative embodiment of the percussive action machine according to the invention in that the housing 1 includes a rigidly secured sleeve 29 intended for a purpose essentially similar to the sleeve 11 of the modification illustrated in FIG. 1. The control valve 18 has the form of two parallel, movably arranged tubes 30 and 31. Each of these tubes is controlled by its own means for locking in the hammer 2; the tube 30—by the inner shoulders of a recess 32, and the tube 31—by the inner shoulders of a recess 33.

Figure 8:
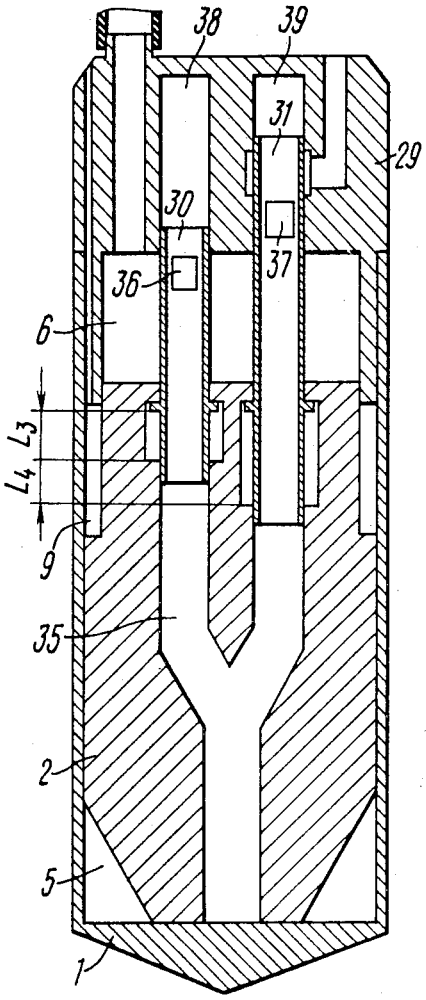
FIG. 8 is a longitudinal sectional view of a preferred embodiment of the percussive action machine in which the tubular control valve has the form of two parallel tubes, the hammer being shown while terminating its forward stroke.

The bore in the hammer 2 has the form of parallel passages 34 and 35 communicable with the return stroke chamber 5. The locking means are fashioned so that the travel length of the tube 30 in the hammer 2 is shorter than the travel length of the tube 31 in the hammer 2 by a value $L_4$ (see FIG. 8). Hole 36 is provided in the wall of the tube 30, the wall of the tube 31 being provided with hole 37.

The end of the tube 30 on which the hole 36 is provided is received by a hole 38 of the sleeve 29, whereas the end of the tube 31 with a hole 37 is disposed in a hole 39 of the sleeve 29.

Thanks to such a construction, the tubular control valve 18 can assume throughout the length $L_4$ of the reverse stroke of the hammer 2 an intermediate position (viz., one when the hole 36 is already closed, while the hole 37 is not yet open) at which the reverse stroke chamber 5 is isolated from the forward stroke chamber 6 and from the outside, whereby the hammer 2 tends to accelerate in the travel length $L_4$ thanks to the energy produced by expansion of compressed air occupying the return stroke chamber 5.

Such an arrangement of the proposed percussive action machine ensures a more economical working cycle during which useful work is done both by the energy of compressed air expended for the prolonged inlet to the reverse stroke chamber 5 (the distance $L_3$ of the hammer stroke as seen best in FIG. 8) and the energy of expansion of compressed air in the return stroke chamber 5 to result in that the power of the compressed air source is utilized to its full potential.

Figure 9:
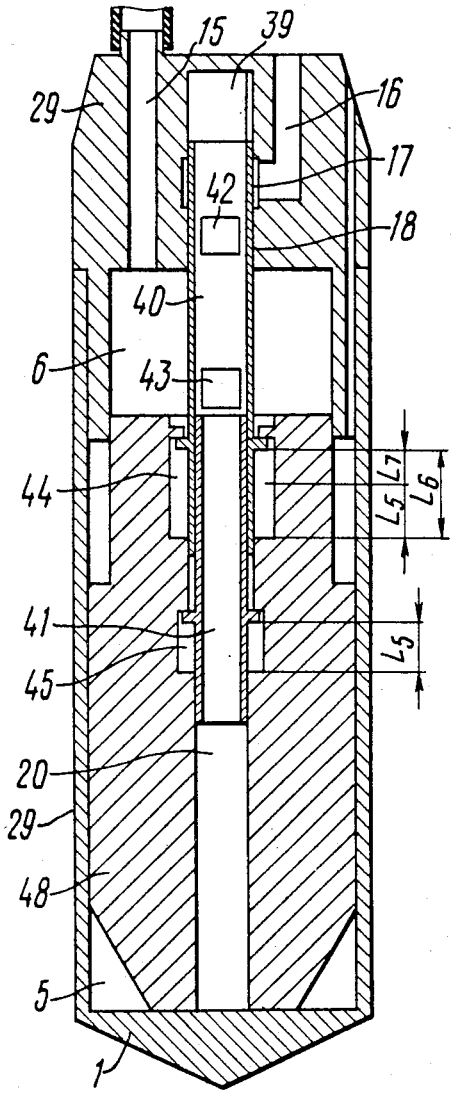
FIG. 9 is a longitudinal sectional view of yet another preferred embodiment of the percussive action machine in which the tubular control valve has the form of two coaxial tubes, the hammer being shown while terminating its forward stroke.

FIG. 9 is an illustration of another preferred embodiment of the percussive actiion machine according to the invention. The housing 1 of the machine has rigidly affixed thereto the sleeve 29 serving the same purpose as the sleeve 11 in the embodiment represented in FIG. 1. A hole 39 of the sleeve 29 receives an end of the tubular control valve 18 having the form of two coaxial tubes 40 and 41. The tube 40 received by the hole 39 is provided with a hole 42 communicating with the discharge passage 16, and a hole 43 wherethrough the return stroke chamber 5 communicates with the forward stroke chamber 6. Each of these tubes is controlled by its own means for locking in the hammer 2, particularly, the tube 40 has inner shoulders of a recess 49 for this purpose, while the tube 41 has shoulders of a recess 45. These locking means are arranged so that the length $L_5$ of travel of the tube 41 in the hammer 2 is shorter than the length $L_6$ of travel of the tube 40 by a value $L_7$. The tube 41 is adapted to open and close the hole 43 of the tube 40.

The percussive action machine for drilling holes in the ground according to the present invention operates in the following manner (FIG. 1).

Figure 2:
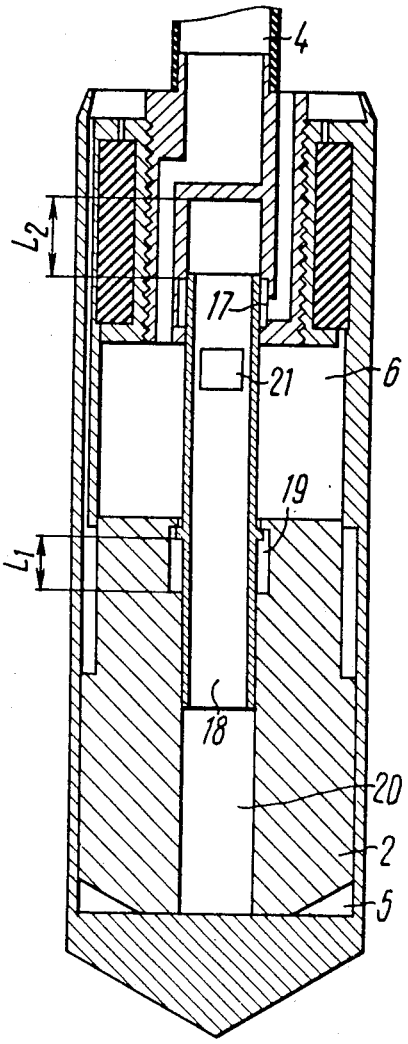
FIG. 2 is a longitudinal sectional view of the percussive action machine showing the hammer at the point of delivering an impact.

Compressed air is fed through the inlet hole 15 to the forward stroke chamber 6 for the hammer 2 to start its travel forward, while the return stroke chamber 5 continuously communicates with the outside through the bore 20, tubular control valve 18 (held in place by the forces of friction from the sleeve 11 during the forward stroke of the hammer), the hole 21, recess 17 and discharge passage 16. At the end of the forward stroke the hammer 2 acts by the inner shoulder of the recess 19 to move the tubular control valve 18 forward (FIG. 2) and deliver an impact on the housing 1 thereby driving it into the ground. In the forward position of the tubular control valve 18 the compressed air flows from the forward stroke chamber 6 through the hole 21 and bore 20 to the reverse stroke chamber 5, whereby the hammer starts its backward motion. For a length of its backward stroke the hammer 2 moves at a uniform acceleration rate, the tubular control valve resting in place. Thereafter, the hammer 2 acts to shift by the inner shoulder of the recess the control valve 18 to the rear position, whereby the hole 21 registers with the recess 17 for the air to escape from the return stroke chamber 5. This initiates a uniformly decelerated travel backwards of the hammer 2 together with the control valve 18 thanks to the kinetic energy acquired thereby at the portion of the stroke terminated by the complete stop of the hammer and the control valve 18 in the rearmost position (FIG. 1).

Figure 3:
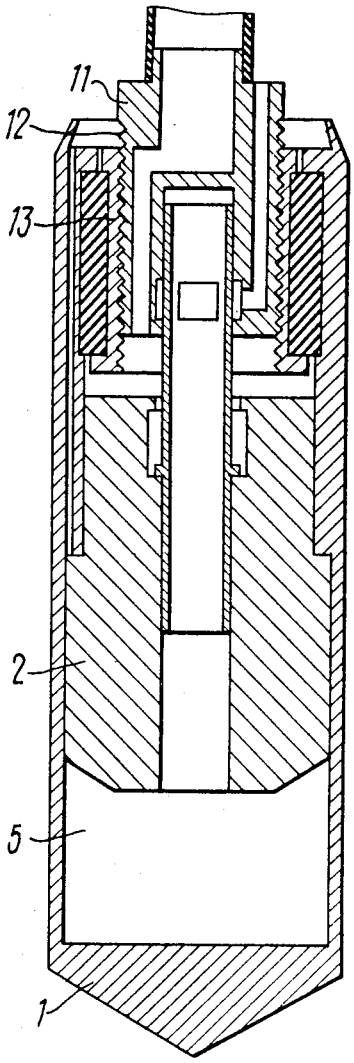
FIG. 3 is a sectional view of the percussive action machine during its reverse percussive action.

In order to reverse the percussive action of the proposed machine, it is necessary to axially displace the sleeve 11 (FIG. 3). The percussive action reversal means is fashioned in this particular case by a threadingly engageable pair including the sleeve 11 and nut 13. By imparting rotation to the sleeve 11 it is possible to set it to the frontmost or rearmost positions corresponding to the forward or backward percussive action of the machine, respectively. Compressed air is admitted to the return stroke chamber 5 earlier during the backward percussive action of the machine than during the forward percussive action for the hammer 2 to be stopped by the compressed air occupying this chamber short of delivering an impact on the housing. Conversely, escape of the air occurs with a delay, and therefore during its reverse stroke the hammer 2 strikes on the housing 1. Under the action of such strikes the machine moves backwards along the hole already made.

For machines in which the deceleration travel of the hammer in its reverse stroke is comparable with the length $L_1$ of its travel for acceleration, a more preferable embodiment is one represented in FIG. 5.

This modification of the percussive action machine operates in a similar manner during the forward stroke of the hammer and during the length $L_1$ of acceleration thereof for the return stroke.

Subsequent to the hammer 2 traveling through the length $L_1$ during the return stroke, it acts to move the tubular control valve 18 the distance $L_2$ to its extreme position by the inner shoulder of the recess 19 through the spring means 27, whereby the hole 21 registers and communicates with the recess 17 for the air to escape from the return stroke chamber 5. The hammer 2 then decelerates and the control valve 18 is immobile whereas the spring means 27 is compressed to lock the control valve 18 in its extreme position.

The tubular control valve 18 is maintained in the thus locked state by the force of compression of the spring means 27 during the forward stroke of the hammer 2 at a portion of its accelerated travel equal in length to the length of decelerated travel of the hammer during its return stroke.

For percussive action machines consuming the amount of air for their operation comparable with the rate of compressed air production fed by a compressed air source it is advisable to make use of the modification with reference to FIGS. 7 and 9.

The embodiment of the percussive action machine shown in FIG. 7 operates as follows.

Compressed air is admitted through the inlet passage 15 to the forward stroke chamber 6. The hammer 2 responds moving forward; the return stroke chamber 5 continuously communicating through the bore 20, tube 31 (remaining immobile during the travel of the hammer), hole 37 and discharge passage 16 with the outside.

At the end of the forward stroke the hammer 2 acts to displace the tube 30 by the inner shoulders of the recesses 32 and 33 forward and delivers an impact on the housing 1 for the machine to be driven into the ground. In the forward position of the tubes 30 and 31 the hole 37 of the tube 31 is closed by the walls of the bore 39, whereas the hole 36 of the tube 30 opens for the compressed air to flow therethrough and through the interior of the tube 30 and passage 35 of the hammer 2 to the return stroke chamber 5. Because the surface area of the hammer 2 on the side of the return stroke chamber 5 is greater than its surface area on the side of the forward stroke chamber 6, the hammer 2 starts its backward travel. The initial portion or length $L_3$ (FIG. 8) of the return stroke travel of the hammer 2 is accompanied by continuous inlet of compressed air to the return stroke chamber at a pressure substantially equalling the feed-line pressure, whereas the subsequent length $L_4$ (FIG. 8) is travelled due to the expansion of the compressed air occupying the reverse stroke chamber 5. At the end of its return stroke the hammer 2 moves the tubes 40 and 41 backward for the return stroke chamber 5 to communicate with the outside through the hole 37, whereby air escapes from the return stroke chamber 5 and the forward stroke of the hammer 2 is initiated.

In the modification of the above construction compressed air is admitted to the reverse stroke chamber 5 through the tube 30 and discharged through the tube 31. This ensures that throughout the length of the forward stroke of the hammer 2 the return stroke chamber 5 communicates with the atmosphere (viz., via the tube 31), whereas the return stroke of the hammer 2 can be viewed as having three stages; initial—accompanied by a continuous admission of compressed air to the return stroke chamber 5; intermediate—accompanied by adiabatic expansion of compressed air in the return stroke chamber 5; and final—when the return stroke chamber 5 communicates with the outside.

Such an arrangement of the percussive action machine makes it possible to admit compressed air to the return stroke chamber 5 and discharge it therefrom via different tubes capable of independent movement. During the forward stroke of the hammer no counterpressure is produced to exert a braking action on the hammer and the return stroke is more economical, that is the compressor power is used more efficiently. As a result, at the same power consumed by the compressor, other conditions being equal, this embodiment is advantageous in that energy losses associated with the need for the hammer to overcome a counterpressure in the return stroke chamber 5 are prevented and in that the kinetic energy of compressed air is used more effectively, whereby the percussive action machine of this modification is more economical in operation and features a greater impact power.

The modification of the percussive action machine illustrated in FIG. 9 operates in the following manner.

Compressed air is admitted through the inlet passage 15 to the forward stroke chamber 6 wherefrom it is conveyed through the hole 43, interior of the tubes 40 and 41 and bore 20 to the return stroke chamber 5. Because the surface area of the hammer 2 on the side of the chamber 5 is greater than the surface area thereof on the side of the chamber 6, the hammer 2 starts its travel backwards. The first portion or length $L_5$ of the return stroke of the hammer is accompanied by continuous admission of compressed air to the return stroke chamber 5 under a pressure substantially equal to the pressure in the air-feeding line.

Subsequent to travelling through the length $L_5$, the hammer 2 acts to displace the tube 41 by the inner shoulders of the recess 45 relative to the tube 40, the latter closing the hole 43 and separating the return stroke chamber 5 from the forward stroke chamber 6. During a subsequent travel of the hammer 2 (a length of its stroke equal to the length $L_7$) the tube 41 is displaced together with the hammer 2 relative to the tube 40, which remains immobile, the movement of the hammer occuring thanks to the energy of expansion of compressed air admitted to the return stroke chamber 5 at the length $L_5$ of travel of the hammer 2. After the hammer 2 travels through the length $L_6$ (from the start of its return stroke), it acts to move the tube 40 rearwards by the inner shoulders of its recess 44 until the hole 42 registers with the recess 17 of the discharge passage 16. Therewith, the return stroke chamber 5 communicates with the outside through the bore 20, interiors of the tubes 40 and 41, hole 42 and discharge passage 16. Air is discharged from the return stroke chamber 5 and the forward stroke of the hammer 2 is initiated during which the return stroke chamber 5 continuously communicates with the outside through the bore 20, tubes 40 and 41, bore 2, recess 17 and discharge passage 16.

At the end of the forward stroke the hammer 2 acts to simultaneously move the tubes 40 and 41 by the inner shoulders of the recesses 44 and 45 so that the hole 42 becomes closed by the walls of the bore 39 of the sleeve 29, while the hole 43 opens, whereby the hammer 2 delivers an impact on the housing 1 to drive it into the ground. The aforedescribed cycle is thereafter repeated.

As compared with the prior art constructions, the proposed percussive action machine for driving holes in the ground ensures a reduction in stresses exerted on the elements of the machine by impact loads, as well as prevents the development of a counterpressure in the return stroke chamber imparting a braking action on the hammer during its forward stroke.

These advantages make the machine 10 to 15% more reliable in operation and provide an infinite increase (within the limits of one outer diameter of the machine) in the impact power through a more extensive hammer stroke.

What is claimed is:

1. A percussive action machine for making holes in the ground, said machine comprising:

a cylindrical housing;

a hammer capable of reciprocations inside said housing;

a forward stroke chamber formed in said housing by said hammer;

an air-feeding line continuously communicating with said forward stroke chamber;

a return stroke chamber alternately communicating with said forward stroke chamber and with the outside;

a conduit means for communicating said return stroke chamber with said forward stroke chamber and with the outside, said conduit means positioned in said hammer;

a sleeve having an opening communicating with the outside, said sleeve secured in said housing;

a tubular control valve movable relative to said hammer and movable within and relative to said sleeve for opening and closing said opening in said sleeve to define with said sleeve an air-distributor;

a control valve moving means carried in said hammer for moving said tubular control valve to assume two extreme positions relative to said hammer, in one of which positions said return stroke chamber communicates through said conduit means in said hammer and through said valve in said air-distributor with the outside, whereas in the other extreme position said valve provides communication between said air feeding line and the forward stroke chamber;

said forward stroke chamber defined between end faces of said sleeve and said hammer;

said conduit means in the form of at least one bore provided in said hammer in line with its axis;

said tubular control valve communicating with said conduit means and extending through said forward stroke chamber;

at least one hole provided in the wall of said tubular control valve wherethrough said return stroke chamber communicates with said forward stroke chamber and with the outside.

2. A percussive action machine as defined in claim 1 in which said sleeve includes a projecting tubular portion defining a wall in which is provided a plurality of holes, a free end of said tubular portion being received by said bore of said hammer, said tubular control valve of said air-distributor being slidably arranged thereon so that in its extreme positions it acts to alternately close said holes in the tubular portion of the sleeve wherethrough said return stroke chamber alternately communicates with said forward stroke chamber and with the outside.

3. A percussive action machine as defined in claim 1 in which said tubular control valve is provided with a spring means for urging said valve into said sleeve subsequent to initial rearward acceleration of said hammer during its return stroke.

4. A percussive action machine as defined in claim 1 in which said tubular control valve has the form of two parallel tubes with the walls of each of these tubes having at least one hole so that in the extreme positions the sleeve alternately closes said hole in one of said tubes wherethrough said return stroke chamber communicates with said forward stroke chamber and said hole in the other of said tubes wherethrough said return stroke chamber communicates with the outside.

5. A percussive action machine as defined in claim 1 in which said tubular control valve has the form of two coaxially cooperating tubes capable of movement relative to each other, the wall of at least one of these tubes having holes closable by the other of said tubes wherethrough said return stroke chamber alternately communicates with said forward stroke chamber and with the outside.

* * * * *